US005490600A

United States Patent [19]

Bustos

[11] Patent Number: 5,490,600

[45] Date of Patent: Feb. 13, 1996

[54] COOLER DISPLAY RACK WITH ADJUSTABLE GRAVITY FEED SHELVES

[75] Inventor: Rafael T. Bustos, Alpharetta, Ga.

[73] Assignee: L&P Property Management Company, Chicago, Ill.

[21] Appl. No.: 234,234

[22] Filed: Apr. 28, 1994

Related U.S. Application Data

[63] Continuation-in-part of Ser. No. 16,783, Feb. 11, 1993, Pat. No. 5,333,746.

[51] Int. Cl.[6] ..... A47F 5/00

[52] U.S. Cl. ..... 211/187; 211/59.2; 211/184

[58] Field of Search ..... 211/184, 59.2, 211/187, 193, 133, 126; 248/242, 243; 108/61, 111, 109

[56] References Cited

U.S. PATENT DOCUMENTS

| | | | |
|---|---|---|---|
| 2,643,170 | 6/1953 | Vanderveld et al. . | |
| 3,120,199 | 2/1964 | Kolster et al. . | |
| 3,601,256 | 8/1971 | Bowers, Jr. et al. . | |
| 3,794,281 | 2/1974 | Munsey . | |
| 3,986,758 | 10/1976 | Heaney . | |
| 4,063,518 | 12/1977 | Bustos . | |
| 4,077,522 | 3/1978 | Trubiano | 211/175 |
| 4,098,480 | 7/1978 | Neumann . | |
| 4,108,085 | 8/1978 | Shepherd et al. . | |
| 4,293,062 | 10/1981 | Bustos . | |
| 4,307,671 | 12/1981 | Albano . | |
| 4,314,648 | 2/1982 | Spamer . | |
| 4,344,367 | 8/1982 | Merl . | |
| 4,593,823 | 6/1986 | Fershko et al. . | |
| 4,706,823 | 11/1987 | Visser . | |
| 4,756,430 | 7/1988 | Spamer et al. . | |
| 4,809,855 | 3/1989 | Bustos . | |
| 4,850,285 | 7/1989 | Suttles . | |
| 4,872,567 | 10/1989 | Bustos . | |
| 4,934,645 | 6/1990 | Breslow . | |
| 4,960,210 | 10/1990 | Spamer . | |
| 5,088,607 | 2/1992 | Risafi et al. . | |
| 5,097,971 | 3/1992 | Norris et al. | 211/181 |
| 5,119,945 | 6/1992 | Wiggins | 211/184 X |
| 5,170,897 | 12/1992 | Wentworth | 211/181 |
| 5,199,584 | 4/1993 | Fowler et al. . | |
| 5,205,421 | 4/1993 | Bustos . | |
| 5,265,740 | 11/1993 | Hodsden et al. . | |
| 5,333,746 | 8/1994 | Bustos | 211/187 |

*Primary Examiner*—Robert W. Gibson, Jr.
*Attorney, Agent, or Firm*—Wood, Herron & Evans

[57] ABSTRACT

A cooler display rack for use in a walk-in refrigerated cooler consists of a series of L-shaped frame sections formed from generally upright posts secured at their bottom end by an elongated shoe to form the individual frame sections. The frame sections are joined to adjacent frame sections by spacer panels and by a plurality of shelves supported in a cantilevered manner between a pair of adjacent posts. The individual shelves are supported between the posts by shelf support brackets and can be selectively positioned vertically along the height of the post, horizontally forward and backward relative to the post, and angularly with a gravity feed inclination between an approximate 8° forward slope and approximate 1° back slope. Bumper wires are inserted through holes in the shelves at the front edge thereof for retaining merchandise contained on the shelves. In one embodiment, a gravity feed shelf includes selectively positionable dividers attached on a slip surface layer of the shelf.

34 Claims, 6 Drawing Sheets

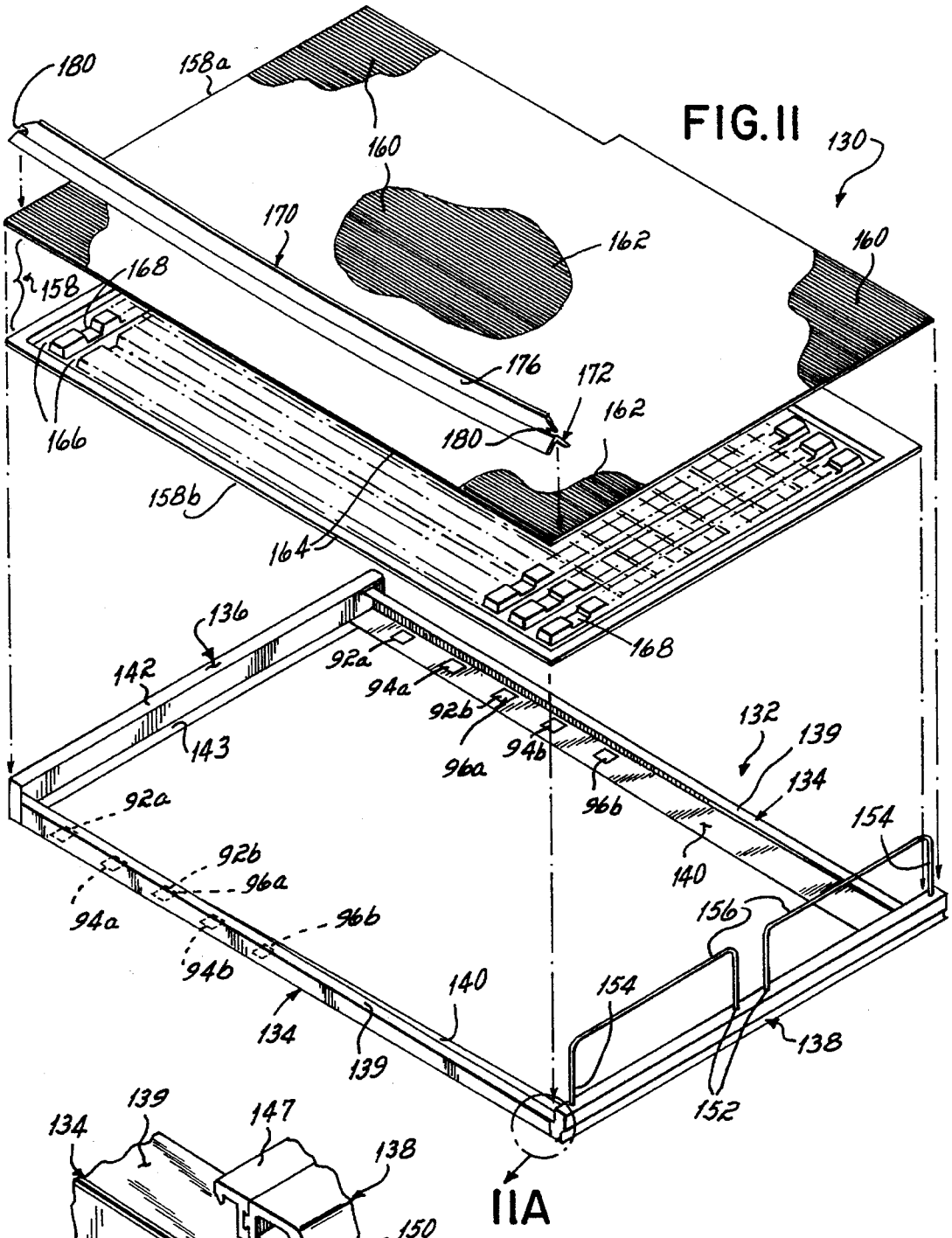
FIG. II
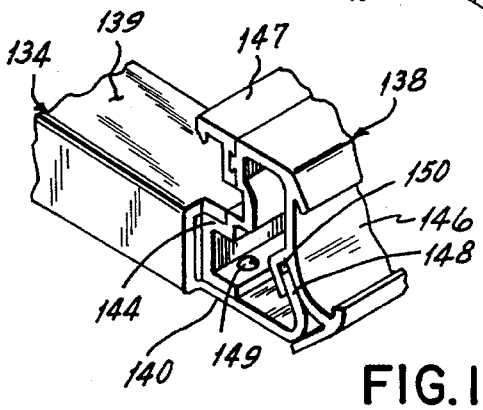
FIG. IIA

COOLER DISPLAY RACK WITH ADJUSTABLE GRAVITY FEED SHELVES

This is a continuation-in-part of application Ser. No. 08/016,783 filed Feb. 11, 1993, now U.S. Pat. No. 5,333, 746.

BACKGROUND OF THE INVENTION

This invention relates to display racks. More particularly, this invention relates to an improved display rack for use in combination with a walk-in type cooler.

The above identified patent application, of which this is a continuation-in-part, is directed to a cooler display rack system which has a shelving design that offers unobstructed continuous display of cooler merchandise due to the elimination of the display rack front posts. The elimination of front posts avoids the need for the shelf width to match the walk-in cooler door width. The cooler display rack system allows the retailer the opportunity of a more individualized allocation of products based on sales merchandising schemes.

This cooler display rack system provides individually adjustable shelves which can be moved forward or back relative to the cooler door without the need for repositioning of the entire display rack. Furthermore, the shelves can be individually adjusted vertically to accommodate varying heights of merchandise, and the shelves can be positioned variably between a 1° back slope inclination up to an 8° forward slope inclination relative to a horizontal plane for a gravity feed system as required. The display rack system includes a plurality of generally L-shaped frame sections having upright posts between which a number of shelves extend forward in a cantilevered manner. Supporting the shelves in a cantilevered fashion allows the posts to be positioned at the rear edge of each shelf thereby allowing full access through the cooler doors to the merchandise located on the shelves facing the cooler doors.

Even though the shelves of the cooler display rack system are adjustable vertically, horizontally and angularly as described, the manner of arranging the merchandise on the individual shelves is not addressed in the above-identified patent application. Gravity feed type display systems often include dividers for partitioning the merchandise into columns. However, the spacing between the dividers, and therefore the width of the merchandise which can be placed therein, is often set or fixed by the shelf manufacturer. If the dividers are fixed, the shelf space is inefficiently used and the store manager has little or no flexibility in arranging merchandise or designing a gravity feed display. Even if the dividers are adjustable, they typically require complicated attachment mechanisms and are difficult to remove and reattach to the shelf when re-configuring the merchandise display.

SUMMARY OF THE INVENTION

It has been an objective of the present invention to provide a display rack with shelves which can be easily re-configured to permit efficient use of the space thereon that do not require fixed or complicated divider attachment mechanisms or structures.

A further objective has been to provide such a display rack shelf which is self-feeding and can be individually adjusted up and down vertically, back and forth horizontally, and at various shelf inclinations.

These objectives of the present invention are obtained by a cooler display rack system as disclosed in the above-identified application, of which this is a continuation-in-part, which includes shelves having adjustable dividers attached thereto. The shelf in the display rack of this invention includes an open frame having front, back and side frame members. A shelf insert is positioned into the open frame to form the shelf. An upper surface of the shelf insert includes a gravity feed slip surface with a plurality of spaced, parallel ribs extending between the front and back edges of the shelf. These ribs perform the dual functions of providing a slip surface for the gravity feed advance of the merchandise toward the front edge of the shelf and an attachment mechanism for dividers extending upwardly from the shelf to partition the upper surface of the shelf into channels.

The dividers include an inverted Y-shaped base which can be positioned at a plurality of places across the top of the slip surface. The base engages adjacent ribs on the slip surface. Each divider has an upwardly bowed configuration and a notch at a front and a back end thereof. A tab on the front and back frame members is inserted into the respective notch on the divider to secure the divider to the shelf. The bowed configuration of the divider helps to securely retain the tabs within the respective notches. The dividers can be easily detached from the shelf and re-attached at different positions.

A pair of adjacent dividers form a channel which organizes the merchandise into a column for the orderly gravity feed advancement on the shelf. The width of the channel is adjustable by repositioning the dividers on the shelf and thereby offering the retailer greater flexibility in designing a merchandising scheme while efficiently utilizing available shelf space.

BRIEF DESCRIPTION OF THE DRAWINGS

The objectives and features of the invention will become more readily apparent from the following detailed description taken in conjunction with the accompanying drawings in which

FIG. 11 is a perspective view of a second embodiment of a gravity feed shelf of this invention;

FIG. 11A is an enlarged view of the side frame member joined to the front frame member;

DETAILED DESCRIPTION OF THE INVENTION

Figures 1, 1A:
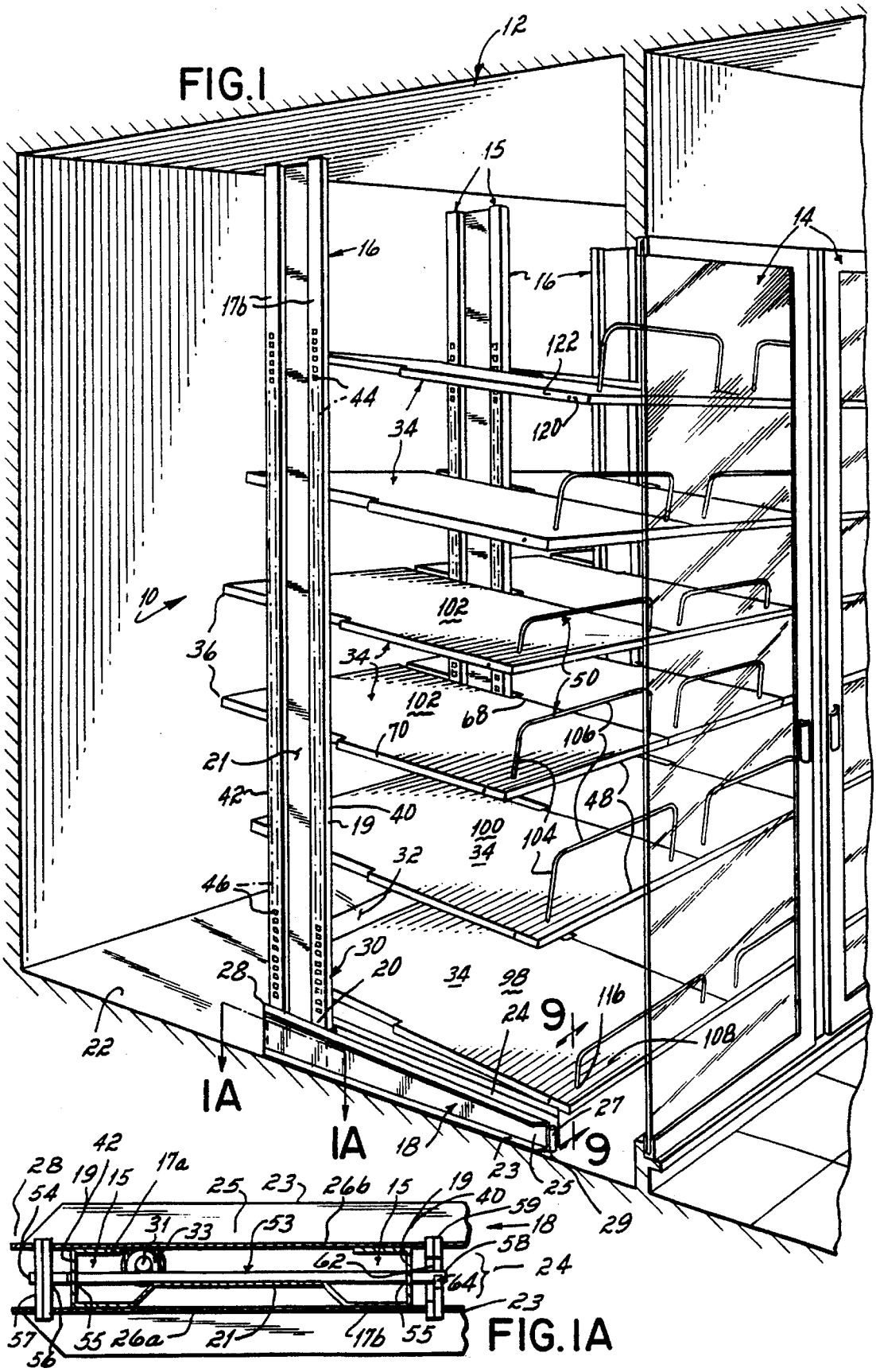
FIG. 1 is a perspective cross-section view of a walk-in cooler having a display rack according to the present invention contained therein.
FIG. 1A is an enlarged cross-sectional view of a post secured in a shoe taken along line 1A—1A of FIG. 1.

Referring to FIG. 1, a cooler display rack system 10 of the present invention is shown within a walk-in refrigerated cooler 12 for which access to merchandise contained on the display rack 10 is available through cooler doors 14. The cooler display rack 10 consists of generally vertical upright posts 16 which are supported by elongated shoes 18 which are located at a lowermost end 20 of the post on a floor 22 of the walk-in cooler. Each shoe 18 has an upwardly open channel 24 formed by a pair of shoe side walls 26*a*, 26*b*. The post 16 is secured between the shoe side walls 26 at the furthermost back end 28 of each shoe 18.

Figure 2:
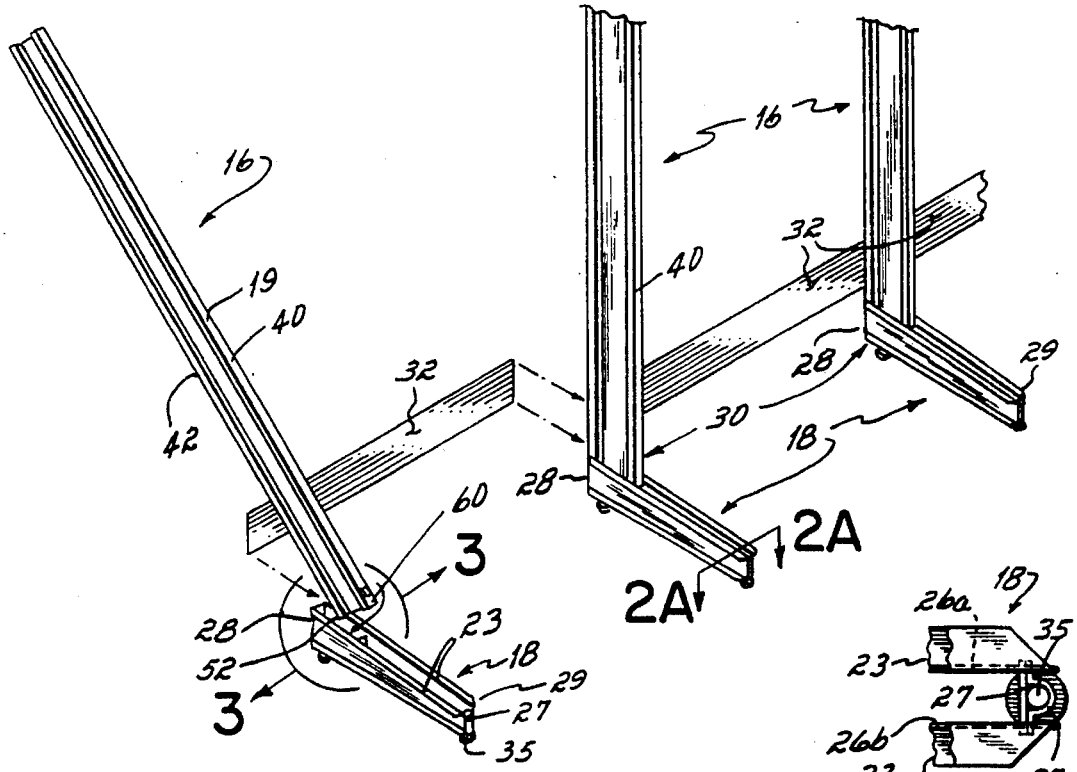
FIG. 2 is an elevated perspective view of a post of the display rack of FIG. 1 being inserted into a shoe to form an L-shaped frame section for attachment to other frame sections.

The post 16 and shoe 18 combination form a generally L-shaped frame section 30 of which a plurality of L-shaped frame sections are joined in a generally parallel configuration by a spacing panel 32 (FIG. 2).

A plurality of shelves 34 of a first embodiment are attached in a cantilever manner between each pair of adjacent upright posts 16 in the present invention. The shelves 34 are attached to the posts 16 such that they extend forward to the cooler doors 14 thereby allowing access by customers through the cooler doors to the merchandise contained thereon. In the cooler display rack system 10 of the present invention full access is available to merchandise contained on the shelves in that there are no front posts to obstruct access to the merchandise. Furthermore, the shelves can be restocked at the appropriate times by accessing a rear edge 36 of the shelves between the upright posts 16.

A cross-sectional view of a post 16 within the shoe 18 is shown in FIG. 1A. Each post 16 is configured as having a pair of open channels 15, 15 each formed by a pair of generally parallel sidewalls 17*a*, 17*b* which are joined by an end channel 19. The channels 15, 15 open toward one another and are joined by a center panel 21 which is an extension of each of the opposing sidewalls 17*b*, 17*b*. The center panel 21 is offset from the sidewalls 17*b*, 17*b* such that it is flush with an insert 53 which is positioned in a bottom end 20 of the post 16. The insert 53 is secured in place by a bolt 31 which is threadably engaged by a collar 33 attached to the insert 53.

The posts 16 of the present invention include on each lateral side wall 17*a*, 17*b* thereof a pair of parallel slot columns 44, 46 of which one column of slots 44 is located near a forward edge 40 of the post and the other column of slots 46 is positioned near a rear edge 42 of each post. The forward column of slots 44 and rear column of slots 46 are each used to support the shelves 34 which may be repositioned vertically along the height of the post 16, within a horizontal plane forward or backward relative to the post 16, and angularly on an incline relative to a horizontal plane, The angular inclination of the shelves 34 provides for a gravity feed system which allows merchandise to be accessed by the customer at a front edge 48 of each shelf and restocked by a store employee from the rear edge 36 of each shelf. A bumper wire 50 as shown in FIG. 1 is provided at the front edge 48 of each shelf to retain the merchandise contained thereon. The selective positioning of the shelves 34 will be described later in this detailed disclosure of the invention.

Figure 2A:
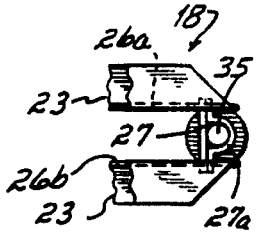
FIG. 2A is an enlarged cross-sectional view of the forwardmost portion of the shoe taken along line 2A—2A of FIG. 2.
Figure 4:
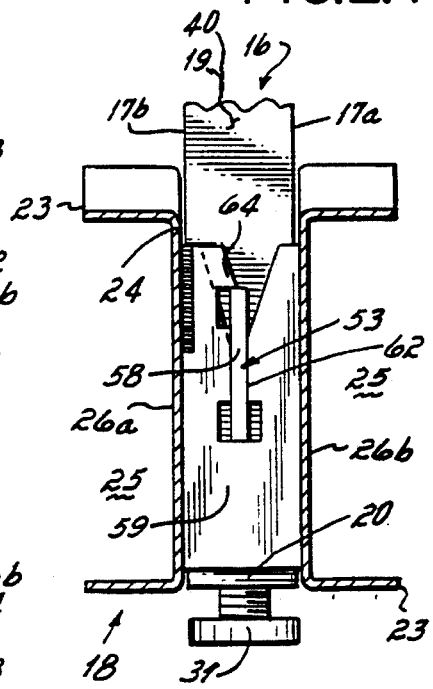
FIG. 4 is a cross sectional front view taken along line 4—4 of FIG. 3A showing the front tab on the bottom end of the post secured in place within the slot provided in the shoe.

FIG. 2 shows the post 16 being inserted into the shoe 18 of the present invention to form the frame section 30 which can be joined by the spacing panel 32 to other frame sections 30. A cross-sectional view of the shoe 18 as in FIG. 4 shows that it is constructed of a pair of U-shaped channels 23, 23 positioned with an opening of each channel 25, 25 directed away from one another. The side walls 26*a*, 26*b* of each shoe form the bottoms of the U-shaped channels 23, 23 and are positioned generally vertical, adjacent, and parallel to each other. As seen in FIG. 2A, the channels 23, 23 are joined by a shoe support 27 at a forward end 29 of each shoe 18. The shoe support 27 includes a collar 27*a* through which a bolt 35 is threadably engaged. The bolts 31, 35 support the shoe at each end and provide for levelling adjustments of the frame section 30 in that the bolts 31, 35 rest on the floor 22 of the cooler 12.

Figure 3:
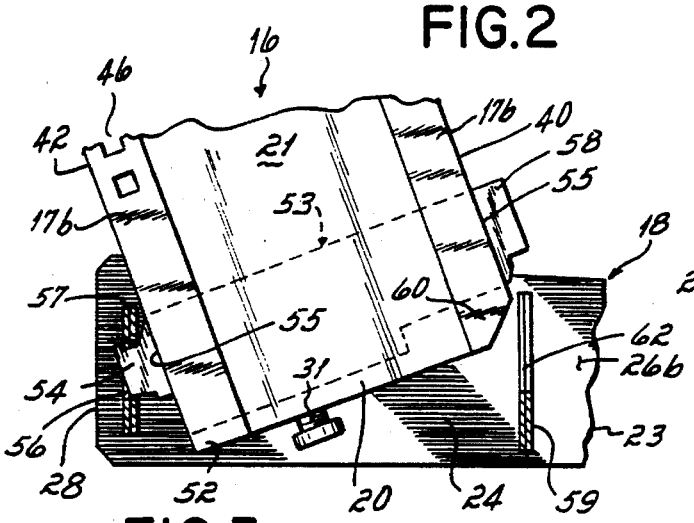
FIG. 3 is an enlarged cross sectional side view of the area of region 3—3 in FIG. 2 as the post is being inserted into the shoe.

To secure the post 16 into the shoe 18 it must be tilted backward with a rearmost bottom edge 52 of the post being inserted into the upwardly open channel 24 provided in the shoe 18. A hook 54 is provided at the rear edge of the bottom end 52 of each post and a tab 58 extends from a forwardmost bottom edge 60 of each post. The hook 54 and tab 68 are on opposite ends of the insert 53 which is located within the bottom end 20 of each post as previously described. The hook 54 and tab 58 project out of the post 16 through slots 55, 55 in the end portion 19 of each post open channel 15. The hook 54 must be inserted into a rear shoe slot 56 as shown in FIG. 3. The rear shoe slot 56 is in a rear shoe support 57 which joins the shoe channels 23, 23 at the back 28 of the shoe 18.

Figure 3A:
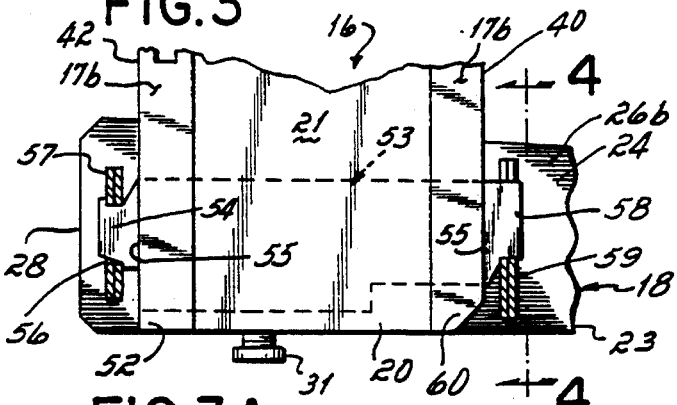
FIG. 3A is a view similar to FIG. 3 after the post has been securely pivoted in place within the shoe.

Once the hook 54 engages the rear shoe slot 56, the post 16 can be pivoted forward until it reaches a generally vertical orientation at which time the tab 58, provided on the forwardmost bottom edge 60 of the post, will slide within a shoe front slot 62 located in a middle shoe support 59, as shown in FIGS. 3A and 4. Once the tab 58 is seated in the forward shoe slot 62, a detente 64 on the middle shoe support 59 which projects into the forward shoe slot 62 engages the tab 58, thereby securing the post 16 within the shoe 18. Once the post 16 is secured to the shoe 18 in a generally vertical orientation, the L-shaped frame member 30 is formed which can then be joined to other L-shaped frame members 30 by the spacing panel 32 which is screwed or fastened by another appropriate mechanism to the rear edge 42 of the post just above the shoe 18 as shown in FIG. 2.

Figure 5:
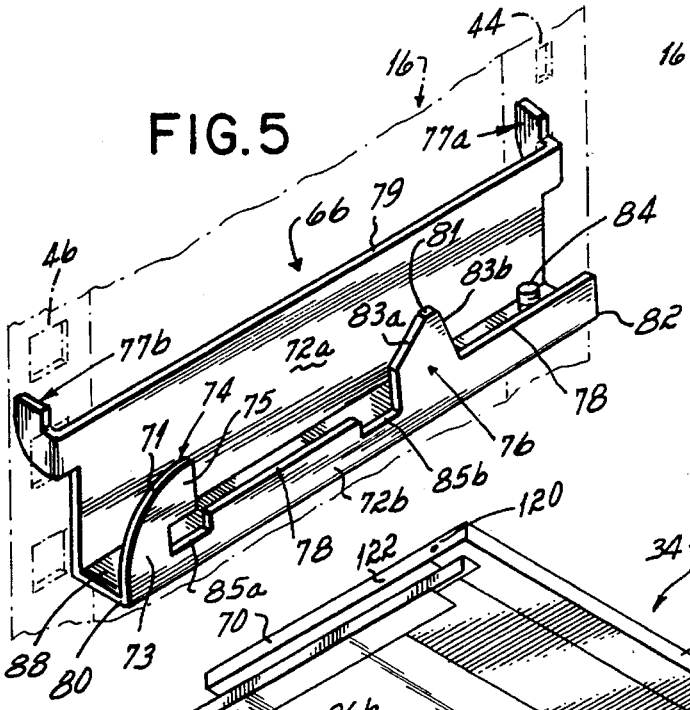
FIG. 5 is a perspective view of a shelf support bracket of the present invention attached to a post shown in phantom.
Figure 7:
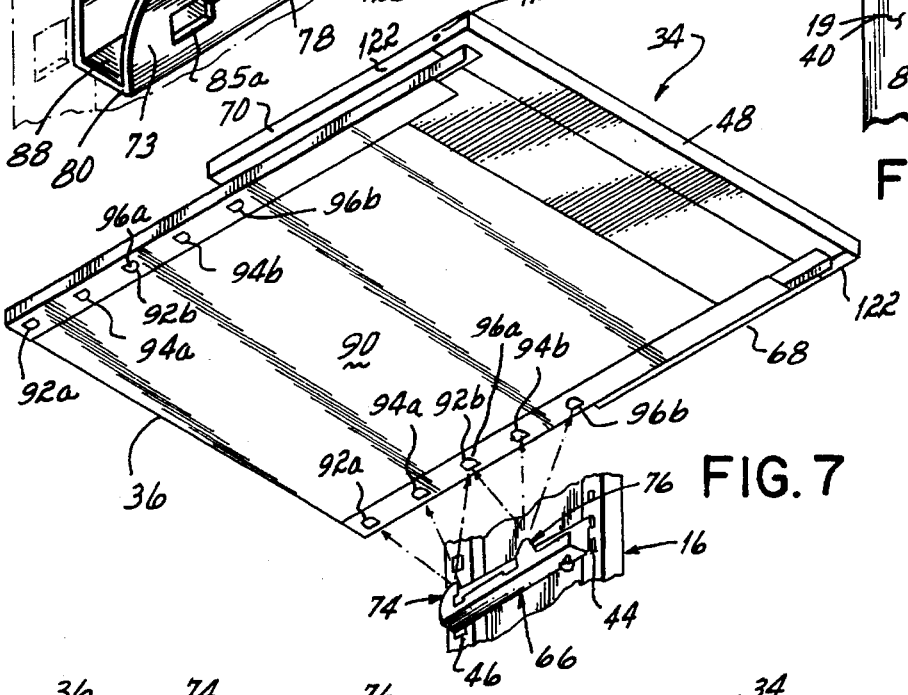
FIG. 7 is a perspective view from the underside of a first embodiment of a shelf which has holes arranged on each lateral edge thereof into which the shelf support bracket hook and stub can be inserted for positioning the shelf forward or backward relative to the post.

Once the appropriate number of frame sections 30 have been joined to fit within the specific dimensions of the walk-in cooler 12, the shelves 34 can be attached between an adjacent pair of posts 16. The shelves 34 are attached to a post 16 by a shelf support bracket 66 on each lateral edge of the shelf. A shelf support bracket which would be suitable for attaching a right side 68 of the shelf to a post 16 is shown in FIG. 7; a similarly designed shelf support bracket 66 would be configured for attachment on a left side 70 of each shelf. As best seen in FIG. 5, each shelf support bracket 66 is generally configured as a U-shaped channel with a pair of channel side walls 72*a*, 72*b* one of which side walls 72*a* has a taller flat edge top surface spaced from the other side wall 72*b* which is of lower height having a shelf hook 74 and a stub 76 extending upward from a top edge 78 thereof. For purposes to be described below, the top edge 78 of side wall 72*b* is sloped at approximately a 1° angle with respect to the top edge 79 of wall 72*a*. That is, the front edge 82 is higher than the rear edge 80 to provide an approximate 1° rearward inclination. The shelf hook 74 is positioned proximate a rear edge 80 of the shelf support bracket sidewall 72*b* and the stub 76 is positioned proximate a front edge 82 of the shelf support bracket sidewall 72*b*. The opposing side wall 72*a* has support hooks 77*a*, 77*b* located at each end of the shelf support bracket 66 on an upper edge 79 thereof.

The shelf hook 74 is of an L-shape having a generally vertical leg 73 which projects up from the side wall 72*b*. A generally horizontal leg 75 extends from the vertical leg 73 and in combination therewith forms the shelf hook 74. The outer surface of the connection between the legs 73 and 75 is formed into an arcuate bend 71 in order to better facilitate the insertion of the shelf hook 74 into the shelf 34 of the present invention. The stub 76 is shaped as a non-symmetric truncated triangle with a flat upper surface 81 and pair of sloped sides 83*a*, 83*b* which connect the flat upper surface 81 to the side wall 72*b*. Adjacent to each of the stub 76 and the shelf hook 74 are cut-outs 85*a*, 85*b* in the top edge 78 of side wall 72*b* in order to assist in attachment of the shelf support bracket 66 to the shelf 34.

Figure 6:
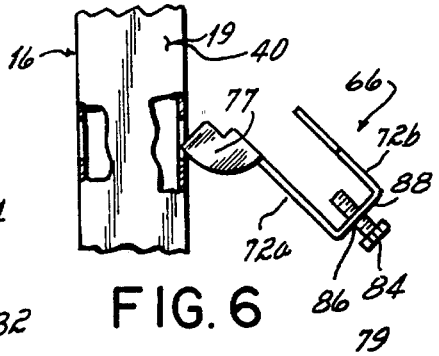
FIG. 6 is a front end view of the hook of a shelf support bracket being inserted into the slot provided on the post of the present invention.
Figure 6A:
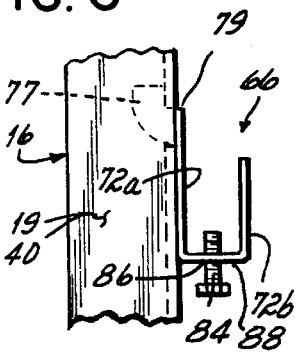
FIG. 6A is a view similar to FIG. 6 after the shelf support has been secured to the post.

FIGS. 6 and 6A show the shelf support 66 being secured to the post slots which 44, 46 are arranged in dual columns on each post 16. The support hooks 77*a*, 77*b* are inserted into the post slot initially with the shelf support 66 oriented at an angle relative to the post 16 as shown in FIG. 6. Once each support hook 77*a*, 77*b* is seated in a post slot in the forward post slot column 44 and the rear post slot column 46, respectively, the shelf support 66 is the pivoted to be parallel with the side 17 of the post as shown in FIG. 6A.

Figure 8:
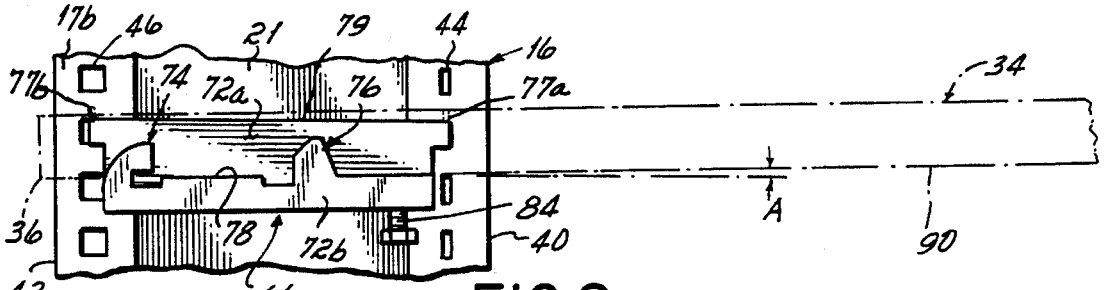
FIG. 8 is a side view showing the post and shelf support bracket attached to a post and with a shelf shown in phantom in an approximately 1° back slope position relative to a horizontal plane.

When the shelf support 66 is positioned in horizontally aligned slots from each column 44,46, the shelf 34 supported thereon would be inclined rearwardly as shown by angle A at approximately a 1° back slope relative to a horizontal plane because of the slope of sidewall 72*b* as shown in FIG. 8. The angled back slope configuration helps prevent merchandise from sliding towards the front edge 48 of the shelf, if so desired. However, an angle B of as much as an 8° forward slope gravity feed shelf orientation can be achieved by inserting the rear support hook 77*b* into a post slot in the rear slot column 46 one position above the post slot into which support hook 77*a* is inserted in the front post column 44, as shown by comparing FIGS. 8 and 8A. The gravity feed orientation for the shelf 34 in the cooler display rack system 10 is desirable for restocking purposes in that once the forwardmost item on the shelf 34 is removed by the customer, as a result of the gravity feed inclination of the shelf subsequent items would advance forward and be retained by the bumper wires 50 which are described later in this disclosure.

Figure 8A:
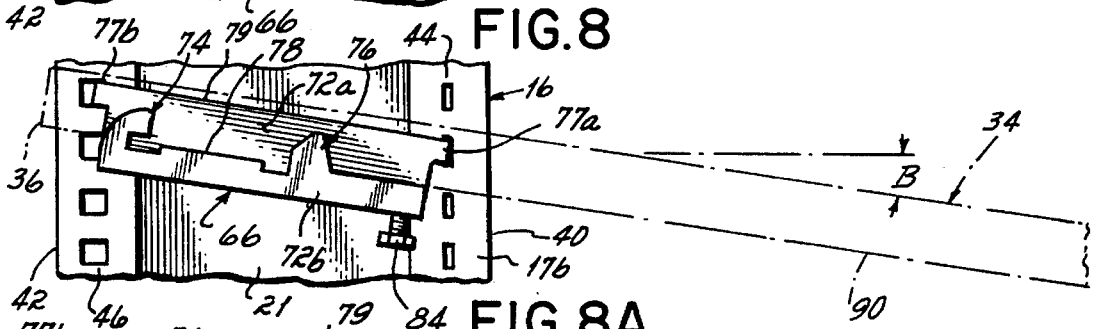
FIG. 8A is a view similar to FIG. 8 showing the shelf in phantom in an approximately 8° forward slope gravity feed position.
Figure 8B:
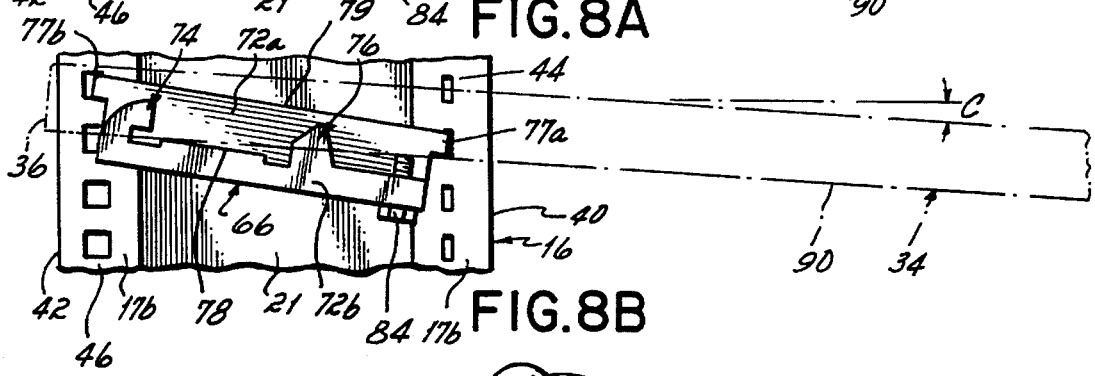
FIG. 8B is a view similar to FIG. 8A showing the shelf in phantom in an approximately 4° forward slope gravity feed position.

FIG. 8B shows the shelf 34 with the support hooks 77*a*, 77*b* located in the same post slot configuration as shown in FIG. 8A, but the shelf 34 of FIG. 8B is positioned at an angle C of approximately a 4° forward slope gravity feed orientation as a result of a screw 84 provided through a threaded hole 86 in a bottom portion 88 of the shelf support. Positive rotation advances the screw 84 through the hole 86 which threadably engages the screw 84. As the screw 84 is rotated and advanced, it contacts a bottom surface 90 of the shelf thereby pivoting the shelf 34 about the shelf hook 74 and adjusting the inclination of the shelf 34 to any orientation between approximately an 8° forward slope as shown by angle B in FIG. 8A to approximately a 4° forward slope as shown by angle C in FIG. 8B depending on the amount of screw rotation. In order to have an appropriately adjusted shelf 34 in the gravity feed orientation of the cooler display rack 10 of the present invention, the shelf support bracket 66 on both the right 68 and left sides 70 of each shelf 34 should be positioned identically in that corresponding post slots should be employed for each post 16 used in supporting each shelf 34 and each screw 84 positioned in each shelf support bracket 66 should be similarly positioned relative to one another.

Figure 7A:
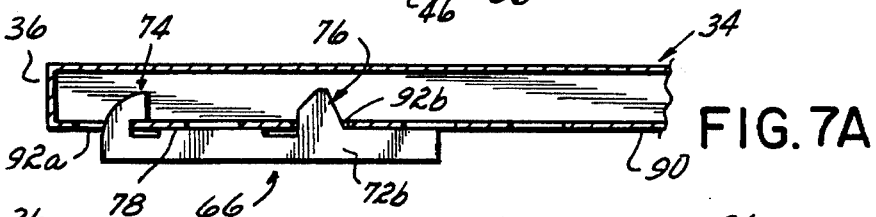
FIG. 7A is a cross-sectional view through the first embodiment of the shelf showing the hook and stub of a shelf support bracket inserted into a pair of holes on the underside of the shelf thereby positioning the shelf in the forwardmost position relative to the post.
Figure 7B:
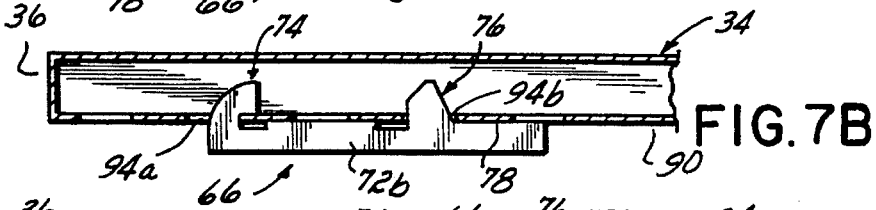
FIG. 7B is a view similar to FIG. 7A showing the shelf hook and stub of a shelf support bracket inserted into another pair of holes thereby positioning the shelf in a middle position relative to the post.
Figure 7C:
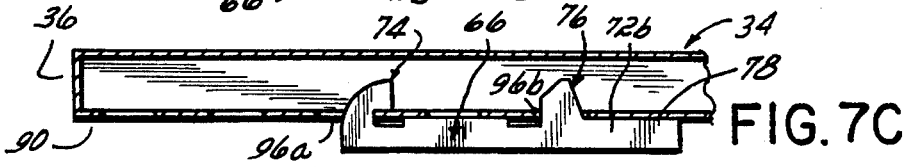
FIG. 7C is a view similar to FIG. 7A showing the shelf hook and stub of the shelf support bracket inserted into yet another pair of holes thereby positioning the shelf in a most rearward position relative to the post.

As shown in FIG. 7, the shelf support bracket 66 engages a series of hole pairs 92*a*–*b*, 94*a*–*b*, 96*a*–*b*, in the bottom side 90 of each shelf along each lateral edge 68, 70. The stub 76 and shelf hook 74 are each inserted into the holes on the bottom side 90 of the shelf. The holes are arranged in three pairs 92, 94 and 96 as shown in FIG. 7. The center hole 92*b*, 96*a* is used as the forward hole 92*b* in pair 92, and the rear hole 96*a* in pair 96. The rearmost hole of each pair 92*a*, 94*a* and 96*a* would be a hook hole adapted to receive the shelf hook 74, and the forwardmost 92*b*, 94*b* and 96*b* of each pair would be a stub hole adapted to receive the stub 76 on the shelf support bracket 66. The provision of multiple pairs of holes for positioning the shelf 34 at various locations forward and aft relative to the post 16 is shown in FIGS. 7A, 7B, and 7C. FIG. 7A shows the position of the shelf 34 relative to the shelf support bracket 66 when the pair of holes 92*a*, 92*b* on the bottom side of each lateral edge of the shelf are utilized. This configuration will provide the shelf 34 with its most forward position relative to the post 16. FIG. 7B shows the positioning of the shelf 34 when the pair of holes identified as 94*a*, 94*b* are utilized. Similarly, FIG. 7C shows the positioning of the shelf 34 at the most rearward location available in the cooler display rack 10 of the present invention by utilizing the pair of holes identified as 96*a*, 96*b*.

The capability of selectively positioning the shelves 34 forward or aft relative to the post 16 is shown in FIG. 1 by comparing the relative positions of the shelves shown in the cooler display rack of the present invention. A bottom shelf 98 is in the most forward position in which holes 92*a*, 92*b* are used; a second lowest shelf 100 is in the middle position utilizing the holes 94*a*, 94*b*. Center shelves 102, 102 are in the most rearward position in which holes 96*a*, 96*b* are used. The capability of positioning the shelves forward and aft relative to the posts, vertically along the height of the post, and at variable gravity feed inclinations offers the convenience or grocery store manager flexibility in merchandising products to be displayed on the cooler display rack of the present invention.

Figure 9:
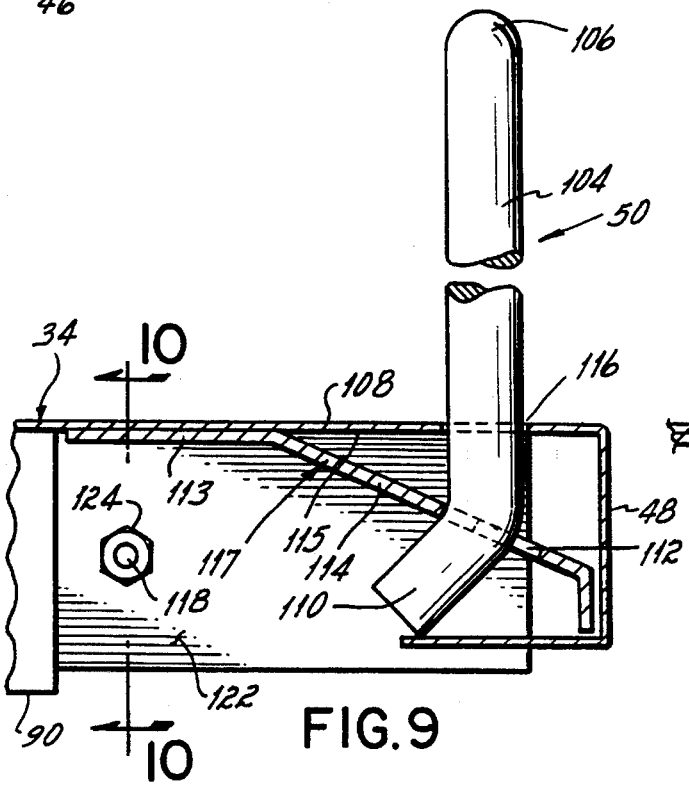
FIG. 9 is a cross sectional view taken along line 9—9 of FIG. 1 showing the forwardmost portion of the shelf with a bumper wire inserted therein.

FIG. 9 shows the bumper wire 50 positioned within a first embodiment of a shelf 34 of the cooler display 10 rack of the present invention. The bumper wire 50 is a generally inverted U-shaped wire as shown in FIG. 1, with a pair of downwardly extending legs 104 joined by a cross bar 106. In FIG. 9, the legs 104 are positioned orthogonal to an upper surface 108 of the shelf. An end portion 110 of each leg is bent to form an obtuse angle with respect to the leg 104. The end portion 110 is seated through a lower hole 112 in a locking tab 114 welded to a bottom side 115 of the shelf surface 108 as shown in FIG. 9. The locking tab 114 has a welded portion 113 which is welded or otherwise affixed to the bottom side 115 of the upper surface 108 of the shelf 34. Forming an obtuse angle with the welded portion 113 is a leaf 117 in which the lower hole 112 is located. The leaf 117 is spaced from and angled with respect to the bottom side 115. The lower hole 112 is positioned at the point where the leg 104 is angled to form the end portion. The leg 104 projects through a hole 116 in the upper surface 108 of the shelf.

The bumper wire 50 inserted into the shelf upper surface 108 and the locking tab 114 insures that a customer cannot remove the bumper wire 50 by merely pulling on the bumper wire 50 in a direction normal to the upper surface 108 of the shelf. The leaf 117 retains the angled end portion 110 to inhibit the bumper wire 50 from being removed orthogonally relative to the upper surface 108 of the shelf. In order to remove the bumper wire 50 from the shelf 34, it must be pulled upward and simultaneously pivoted toward the rear end 36 of the shelves so that the end portion 110 of the bumper wire leg can be removed from the lower hole 112 in the leaf 117 within the shelf. Therefore, if merchandise is accumulated on the shelf 34 and being retained by the bumper wire 50, the bumper wire 50 could not be removed in that it could not be pivoted towards the rear edge 36 of the shelf due to the merchandise contained thereon.

In order to insert the bumper wire 50 into the shelf 34, the end portion 110 of the leg would be initially inserted normal to the upper surface 108 of the shelf through the upper hole 116, and then as the bumper wire 50 is pushed down it is simultaneously pivoted toward the front edge 48 of the shelf so the end portion 110 can project through the lower hole 112 in the lower panel 114 of the shelf to achieve the configuration shown in FIG. 9.

A second preferred embodiment for a shelf 130 for use with the cooler display rack system 10 of this invention is shown in FIGS. 11 through 16. This shelf design can be incorporated into the display rack system 10 for variable vertical, horizontal and angular adjustments just as were described with reference to the shelf design 34 of the first embodiment. The second shelf design embodiment 130 includes a generally rectangular open frame 132 consisting of a pair of spaced side frame members 134 connecting a back frame member 136 to a front frame member 138 (FIG. 11). Each side frame member 134, 134 consists of a generally U-shaped channel with a horizontal top leg 139 and a lower wider leg 140. The leg 140 of the shaped channel is fixedly secured at the back end to the lower leg of the back frame 136. The series of hole pairs 92*a–b*, 94*a–b*, 96*a–b* are provided in the longer leg 140 of the side frame member 134 for attachment to the shelf support bracket 66 as was described with reference to the first embodiment of the shelf 34.

The back frame member 136 consists essentially of a box shaped channel having an open side directed toward the interior of the open front frame 132. The legs 140 of side frame members 134, 134 are inserted into the respective ends of an inwardly facing lower leg 143 of the back frame member 136 box channel as shown in FIG. 11. A tab 142 projecting inwardly toward the interior of the open frame 132 is also formed on the upper channel side wall of the back frame member 136.

Figures 12, 13, 14, 15, 16:
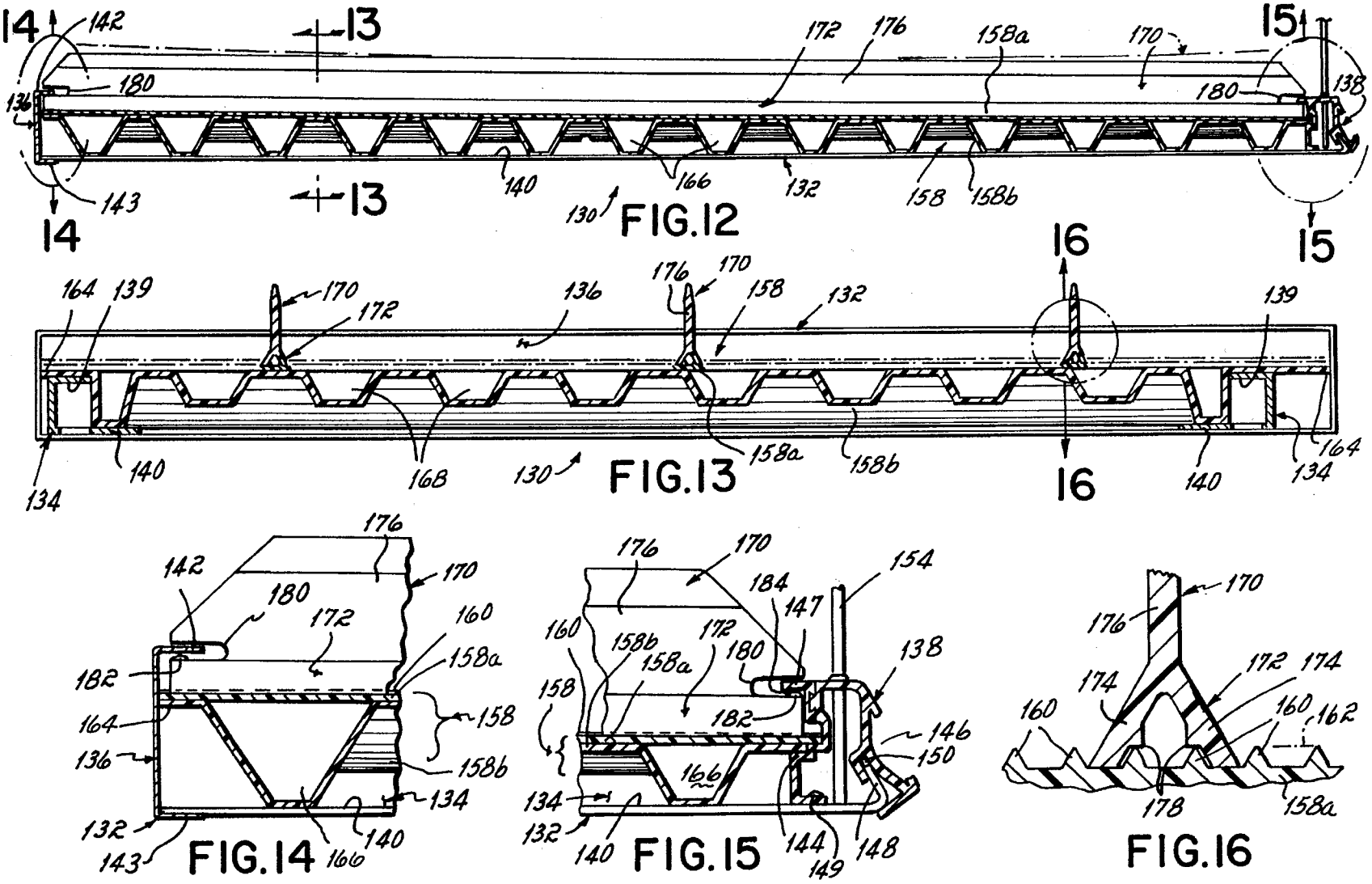
FIG. 12 is a cross-sectional view of the shelf of FIG. 11.
FIG. 13 is another cross-sectional view of the shelf of FIG. 11.
FIG. 14 is an enlarged broken away side view of a divider secured to the back edge of the shelf of FIG. 12.
FIG. 15 is an enlarged broken away side view of the front end of the divider secured to the front edge of the shelf of FIG. 12.
FIG. 16 is an enlarged cross-sectional view showing the attachment of the divider to the slip surface layer of FIG. 13.

The front frame member 138 also consists essentially of a box-shaped channel having an inwardly facing transverse ledge 144 which extends to each end thereof. This ledge 144 accepts on each end the front ends of upper legs 139 of the side frame members 134, 134 as shown in FIG. 11A. The front frame member 138 also includes a tab 146 projecting toward the interior of the open frame 132 as shown in FIG. 15. Extending along the front edge of the front frame member 138 is an open upwardly angled channel 146 in which a price sticker or label (not shown) can be inserted relating to the merchandise supported on the shelf as is well known in the art. A front end of each side frame member's lower leg 140 includes an upstanding hook 148 which engages a slot 150 formed in the front frame member 138 proximate the back side of the price channel 146 as shown in FIG. 15. The legs 140 are fixedly secured to the front frame member 138 by rivets 149, or the like.

A plurality of holes 152 are also included in the front frame member 138 in the uppermost side of the box-shaped channel. The holes 152 are positioned and adapted to receive legs 154 of a generally U-shaped bumper wire 156 as shown in FIG. 11. The legs 154 of a bumper wire 156 are inserted through the holes 152 in the front frame member 138 to attach the bumper wires 156 at the front edge of the shelf 130 and retain the merchandise thereon.

A shelf insert 158 comprises an upper sheet 158*a* and a lower support grid 158*b* as shown in FIG. 11 and is inserted into the open frame 132 to form the shelf 130 in this preferred embodiment. The shelf insert 158*a* is preferably formed from plastic and has a plurality of spaced, generally parallel ribs 160 on an upper surface thereof extending longitudinally from the back edge to the front edge of the shelf. The ribs 160 provide a slip surface layer 162 on the upper surface of the shelf insert 158*a* so that when the shelf 130 is in a gravity feed orientation, merchandise supported thereon advances by gravity atop the slip surface layer 162 toward a front edge of the shelf 130. The merchandise is prevented from sliding off the front edge of the shelf 130 by the bumper wires 156 inserted into the front frame member 138. Preferably, a silicone additive or coating is added to the slip surface layer 162 to reduce the friction between the merchandise and the shelf insert 158*a*. The shelf insert 158 is supported along the sides by the longer leg 140 of the side frame members 134, 134 and by the upper legs 139 forming a side edge for a perimeter retaining rim 164 formed on the underside of the insert 158*a* which rests upon the frame 132 as shown in FIGS. 12–15.

In addition to the retaining rim 164 around the perimeter, the lower support grid 158*b* includes a plurality of laterally extending channels 166 and a plurality of longitudinally extending, more shallow, channels 168. In combination, the laterally and longitudinally extending channels 166, 168 form a checkerboard like configuration. The channels 166, 168 of support grid 158*b* provide added rigidity and structural support to the shelf 130. As a result, the insert 158 can be constructed of a lightweight, durable and cost effective material, preferably plastic. Preferably, the laterally extending channels 166 are deeper forming a larger profile in cross-section (FIG. 12) than the longitudinally extending channels 168 (FIG. 13) to support the shelf on its lateral edges.

Dividers 170 are provided for attachment to the shelf 130 in this preferred embodiment. The dividers 170 project perpendicularly from the upper surface of the shelf 130 and extend longitudinally between the front and rear frame members 138, 136. The dividers 170 can be selectively attached and detached at a plurality of positions across the upper slip surface layer 162 of the shelf 130. The dividers 170 cooperate to form channels and separate the merchandise into columns for arrangement on the shelf 130. In the gravity feed configuration, the merchandise is arranged longitudinally on the shelf 130 in the channels between adjacent dividers 170. When the forwardmost item of merchandise is removed from the front edge of the shelf 130, the remaining items in the column behind the removed item advance by gravity atop the slip surface layer 162 toward the front edge of the shelf 130. As a result, the dividers 170 prevent the merchandise in an adjacent column from interfering with the gravity feed advance of the merchandise.

A bottom portion of each divider 170 has a generally inverted Y-shaped base 172 as shown generally in FIG. 13 and particularly in FIG. 16. The Y-shaped base 172 consists of a pair of legs 174, 174 which support a generally planar upper portion 176 of the divider 170. A bottom surface of each leg 174 of the base 172 is inserted between adjacent ribs 160 of the shelf insert 158. Each leg 174 includes a lip projecting 178 inwardly toward the center of the base 172 to engage the upper surface of the rib 160 and stabilize the divider 170 on the shelf 130.

As shown in FIGS. 14 and 15, a notch 180 with an upwardly directed detent 182 formed on the lower side wall of the notch 180 is provided on the rear and front ends of each divider 170. Furthermore, as shown in FIG. 12, each divider 170 has a generally bowed configuration in which the front and rear ends are bowed upwardly relative to a middle portion of the divider 170. The dividers 170 are preferably extruded plastic and, as a result, are flexible and bendable. The tabs 142, 147 extending from the rear and front frame members are inserted into the notches 180, 180 at the rear and front ends, respectively, of the divider 170 as shown in FIGS. 14 and 15. A hook 184 may be provided on the tab 147 as shown in FIG. 15 to engage the detent 182 in the front notch 180. Due to its bowed configuration, the divider 170 is securely retained on the shelf 130 with the bottom portion of the notch 180 and detent 182 being forced upwardly against the tab 142 or 147 in the frame member. Furthermore, the bowed configuration assists the divider base legs 174 in maintaining a stable and secure position between the adjacent ribs 160. The bowed configuration produces a friction fit of the divider 170 onto the upper slip surface 162 between adjacent ribs 160 and into engagement with the front and rear frame members 138, 136. Advantageously, the divider 170 can be easily removed or detached from a set position on the shelf 130 and reinstalled on the shelf 130 without damaging any of the components or requiring complicated and lengthy assembly procedures. As a result, the dividers 170 can be selectively positioned on the shelf 130 to form channels for merchandise of a variety of widths and efficiently utilize available shelf space.

Figure 10:
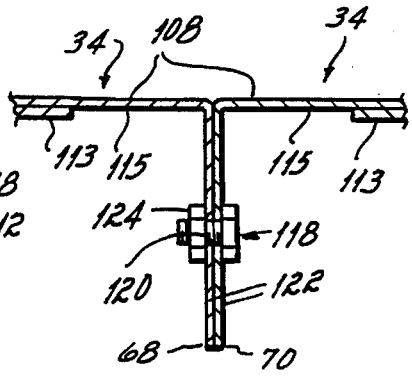
FIG. 10 is a cross sectional front view taken along line 10—10 of FIG. 9 showing the attachment bolt joining adjacent shelves of the present invention.

A final feature of the cooler display rack system of the present invention is a shelf connecting bolt 118 as shown in FIG. 10. The bolt 118 or other suitable attachment mechanism, would be used to join adjacent shelves 34 or 130 on a cooler display 10 rack in order to provide more stability and rigidity to the rack structure as a whole. The shelf attachment bolt 118 would be inserted through a hole 120 in a downwardly extending flange 122 on each lateral edge 68, 70 on an adjacent pair of shelves 34 or 130 and would be secured in place by a nut 124 as shown in FIG. 10. The provision of a shelf attachment bolt 118 would be an optional feature to the construction of the present invention in that it does provide more stability to the shelf structure, but also requires that adjacent shelves 34 or 130 be identically positioned on the respective shelf support brackets 66 which may not be the case for certain applications of the present invention.

From the above disclosure of the general principles of the present invention and the preceding description of the preferred embodiment those skilled in the art will readily comprehend the various modifications to which the present invention is susceptible. Therefore, I desire to be limited only by the scope of the following claims and equivalents thereof.

I claim:

1. A display rack for providing access to merchandise supported thereon comprising:

plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section to an adjacent said frame section;

at least one shelf extending between an adjacent pair of said posts, said shelf being secured by attachment means for mounting said shelf in a generally cantilever manner between said adjacent pair of posts;

said shelf further comprising:

a frame having a pair of spaced side members connecting a front member spaced from a back member;

a shelf insert supported on said frame, said shelf insert having a slip surface upper layer for gravity feed advance of the merchandise thereon;

a divider attached to an uppermost surface of said slid surface upper layer without being interlocked therewith, said divider projecting upwardly from said slip surface upper layer and extending between said front frame member and said rear frame member to guide the merchandise advancing toward said front frame member, said divider being selectively attachable and detachable from said slip surface upper layer at a plurality of positions on said insert.

2. The display rack of claim 1 further comprising:

a plurality of upwardly projecting spaced ribs on said slip surface upper layer, said ribs being generally parallel and extending between said front frame member and said rear frame member.

3. The display rack of claim 2 wherein said divider has a generally inverted Y-shaped base, each leg of said inverted Y-shaped base having a lip projecting therefrom, each said leg of said base being inserted between a pair of adjacent said ribs and each said lip engaging one of said ribs.

4. A display rack for providing access to merchandise supported thereon comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section to an adjacent said frame section;

at least one shelf extending between an adjacent pair of said posts, said shelf being secured by attachment means for mounting said shelf in a generally cantilever manner between said adjacent pair of posts;

said shelf further comprising:

a frame having a pair of spaced side members connecting a front member spaced from a back member;

a shelf insert supported on said frame, said shelf insert having a slip surface upper layer for gravity feed advance of the merchandise thereon;

a divider positioned atop said shelf insert, said divider projecting upwardly from said slid surface upper layer and extending between said front frame member and said rear frame member to guide the merchandise advancing toward said front frame member, said divider being selectively attachable and detachable from said slip surface upper layer at a plurality of positions on said insert;

notch at a front end and a notch at a rear end of said divider; and a tab projecting from each said front frame member and said rear frame member, said front frame member tab and said rear frame member tab being inserted into said front end notch and said rear end notch, respectively, to attach said divider to the shelf.

5. The display rack of claim 4 wherein said divider has an upwardly directed bowed configuration such that said front and rear ends each bow upwardly relative to a middle portion of said divider, said upwardly bowed configuration enabling said front and rear end notches to engage said front and rear frame member tabs, respectively, and secure said divider to the shelf.

6. The display rack of claim 4 further comprising:

a detent within each said notch, said detent engaging said tab when said divider is attached to said shelf.

7. A display rack for providing access to merchandise supported thereon comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section to an adjacent said frame section;

at least one shelf extending between an adjacent pair of said posts, said shelf being secured by attachment means for mounting said shelf in a generally cantilever manner between said adjacent pair of post;

said shelf further comprising:

a frame having a pair of spaced side members connecting a front member spaced from a back member;

a shelf insert supported on said frame, said shelf insert having a slip surface upper layer for gravity feed advance of the merchandise thereon;

divider positioned atop said shelf insert, said divider projecting upwardly from said slip surface upper layer and extending between said front frame member and said rear frame member to guide the merchandise advancing toward said front frame member, said divider being selectively attachable and detachable from said slid surface upper layer at a plurality of positions on said insert;

a plurality of laterally extending channels formed in an under side of said shelf insert; and a plurality of longitudinally extending channels formed in said shelf insert under side, said laterally and longitudinally extending channels providing added structural rigidity to said shelf insert.

8. The display rack of claim 1 further comprising:

a stop at said front edge of said shelf to retain merchandise supported thereon.

9. The display rack of claim 8 wherein said stop comprises a generally inverted U-shaped bumper wire having a pair of downwardly extending legs, each said leg being inserted into a hole in said shelf.

10. In combination, a walk-in cooler and a cooler display rack for providing displayed access to merchandise supported upon the rack and located within the walk-in cooler, said cooler display rack comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section;

at least one shelf extending between an adjacent pair of said posts, said shelf being secured by attachment means for mounting said shelf in a generally cantilever manner between said adjacent pair of posts;

said shelf further comprising:

a frame having a pair of spaced side members connecting a front member spaced from a back member;

a shelf insert supported on said frame, said shelf insert having a slip surface upper layer for gravity feed advance of the merchandise thereon;

a divider attached to an uppermost surface of said slid surface upper layer without being interlocked therewith, said divider projecting upwardly from said slip surface upper layer and extending between said front frame member and said rear frame member to guide the merchandise advancing toward said front frame member, said divider being selectively attachable and detachable from said slip surface upper layer at a plurality of positions on said insert.

11. The combination of claim 10 further comprising:

a plurality of upwardly projecting spaced ribs on said slip surface upper layer, said ribs being generally parallel and extending between said front frame member and said rear frame member.

12. The combination of claim 11 wherein said divider has a generally inverted Y-shaped base, each leg of said inverted Y-shaped base having a lip projecting therefrom, each said leg of said base being inserted between a pair of adjacent said ribs and each said lip engaging one of said ribs.

13. In combination, a walk-in cooler and a cooler display rack for providing access to merchandise supported upon the rack and located within the walk-in cooler, said cooler display rack comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section;

at least one shelf extending between an adjacent pair of said posts, said shelf being secured by attachment means for mounting said shelf in a generally cantilever manner between said adjacent pair of posts;

said shelf further comprising:

a frame having a pair of spaced side members connecting a front member spaced from a back member;

a shelf insert supported on said frame, said shelf insert having a slip surface upper layer for gravity feed advance of the merchandise thereon;

a divider positioned atop said shelf insert, said divider projecting upwardly from said slip surface upper layer and extending between said front frame member and said rear frame member to guide the merchandise advancing toward said front frame member, said divider being selectively attachable and detachable from said slip surface upper layer at a plurality of positions on said insert;

a notch at a front end and a notch at a rear end of said divider; and a tab projecting from each said front frame member and said rear frame member, said front frame member tab and said rear frame member tab being inserted into said front end notch and said rear end notch, respectively, to attach said divider to the shelf.

14. The combination of claim 13 wherein said divider has an upwardly directed bowed configuration such that said front and rear ends each bow upwardly relative to a middle portion of said divider, said upwardly bowed configuration enabling said front and rear end notches to engage said front and rear frame member tabs, respectively, and secure said divider to the shelf.

15. The combination of claim 13 further comprising:

a detent within each said notch, said detent engaging said tab when said dividers is attached to said shelf.

16. In combination, a walk-in cooler and a cooler display rack for providing access to merchandise supported upon the rack and located within the walk-in cooler, said cooler display rack further comprising:

a plurality of generally upright posts having a top end, a bottom end, a front edge, a rear edge, and a pair of lateral spaced sides;

base means attached to the bottom end of each said post for bracing said post in a generally vertical orientation, said post and said base means forming a generally L-shaped frame section;

connecting means for joining in spaced and generally parallel relation each said frame section;

at least one shelf extending between an adjacent pair of said posts, said shelf being secured by attachment means for mounting said shelf in a generally cantilever manner between said adjacent pair of posts;

said shelf further comprising:

a frame having a pair of spaced side members connecting a front member spaced from a back member;

a shelf insert supported on said frame, said shelf insert having a slip surface upper layer for gravity feed advance of the merchandise thereon;

a divider positioned atop said shelf insert, said divider projecting upwardly from said slip surface upper layer and extending between said front frame member and said rear frame member to guide the merchandise advancing toward said front frame member, said divider being selectively attachable and detachable from said slid surface upper layer at a plurality of positions on said insert;

a plurality of laterally extending channels formed in an under side of said shelf insert; and a plurality of longitudinally extending channels formed in said shelf insert under side, said laterally and longitudinally extending channels providing added structural rigidity to said shelf insert.

17. The combination of claim 10 further comprising:

a stop at said front edge of said shelf to retain merchandise supported thereon.

18. The combination of claim 17 wherein said stop comprises a generally inverted U-shaped bumper wire having a pair of downwardly extending legs, each said leg being inserted into a hole in said shelf.

19. A shelf for displaying merchandise supported thereon, said shelf comprising:

a frame having a pair of spaced side members connecting a front member spaced from a back member;

a shelf insert supported on said frame, said shelf insert having a slip surface upper layer for gravity feed advance of the merchandise thereon;

a divider positioned atop said shelf insert, said divider projecting upwardly from said slip surface upper layer and extending between said front frame member and said rear frame member to guide the merchandise advancing toward said front frame member, said divider being selectively attachable and detachable from said slip surface upper layer at a plurality of positions on said insert, said divider having an upwardly directed bowed configuration such that said front and rear ends each bow upwardly relative to a middle portion of said divider;

a notch at a front end and a notch at a rear end of said divider; and a tab projecting from each said front frame member and said rear frame member, said front frame member tab and said rear frame member tab being inserted into said front end notch and said rear end notch, respectively, said upwardly bowed configuration enabling said front and rear end notches to engage said front and rear frame member tabs, respectively, and secure said divider to the shelf.

20. The shelf of claim 19 further comprising:

a plurality of upwardly projecting spaced ribs on said slip surface upper layer, said ribs being generally parallel and extending between said front frame member and said rear frame member.

21. The shelf of claim 20 wherein said divider has a generally inverted Y-shaped base, each leg of said inverted Y-shaped base having a lip projecting therefrom, each said leg of said bottom surface being inserted between a pair of adjacent said ribs and each said lip engaging one of said ribs.

22. The shelf of claim 19 further comprising:

a plurality of laterally extending channels formed in an under side of said shelf insert; and a plurality of longitudinally extending channels formed in said shelf insert under side, said laterally and longitudinally extending channels providing added structural rigidity to said shelf insert.

23. The shelf of claim 19 further comprising:

a detent within each said notch, said detent engaging said tab when said divider is attached to the shelf.

24. A shelf for a gravity feed display rack comprising:

a frame having a pair of spaced side members connecting a front member spaced from a back member;

at least one shelf insert supported on said frame;

a slip surface layer positioned atop said at least one shelf insert for gravity feed advance of merchandise thereon; and a divider attached to an uppermost surface of said slip surface upper layer without being interlocked therewith, said divider projecting upwardly from said slip surface layer and extending between said front frame member and said rear frame member to guide the merchandise advancing toward said front frame member, said divider being selectively attachable and detachable from said slip surface layer at a plurality of positions on the shelf.

25. The shelf of claim 24 further comprising:

a plurality of upwardly projecting spaced ribs on said slip surface layer, said ribs being generally parallel and extending between said front frame member and said rear frame member.

26. The shelf of claim 25 wherein said divider has a generally inverted Y-shaped base, each leg of said inverted Y-shaped base having a lip projecting therefrom, each said leg of said base being inserted between a pair of adjacent said ribs and each said lip engaging one of said ribs.

27. A shelf for a gravity feed display rack comprising:

a frame having a pair of spaced side members connecting a front member spaced from a back member;

at least one shelf insert supported on said frame;

a slid surface layer positioned atop said at least one shelf insert for gravity feed advance of merchandise thereon;

a divider positioned atop said slip surface layer, said divider projecting upwardly from said slip surface layer and extending between said front frame member and said rear frame member to guide the merchandise advancing toward said front frame member, said divider being selectively attachable and detachable from said slip surface layer at a plurality of positions on the shelf;

a notch at a front end and a notch at a rear end of said divider; and a tab projecting from each said front frame member and said rear frame member, said front frame member tab and said rear frame member tab being inserted into said front end notch and said rear end notch, respectively, to attach said divider to the shelf.

28. The shelf of claim 27 wherein said divider has an upwardly directed bowed configuration such that said front and rear ends each bow upwardly relative to a middle portion of said divider, said upwardly bowed configuration enabling said front and rear end notches to engage said front and rear frame member tabs, respectively, and secure said divider to the shelf.

29. The shelf of claim 27 further comprising:

a detent within each said notch, said detent engaging said tab when said divider is attached to said shelf.

30. The shelf of claim 27 further comprising:

a plurality of laterally extending channels formed in an under side of said shelf insert.

31. The shelf of claim 27 further comprising:

a plurality of longitudinally extending channels formed in an under side of said shelf insert.

32. The shelf of claim 24 further comprising:

a stop at said front edge of said shelf to retain merchandise supported thereon.

33. The shelf of claim 32 wherein said stop comprises a generally inverted U-shaped bumper wire having a pair of downwardly extending legs, each said leg being inserted into a hole in the shelf.

34. The shelf of claim 24 wherein the shelf is suspended in a cantilever configuration on the display rack.

* * * * *

UNITED STATES PATENT AND TRADEMARK OFFICE

CERTIFICATE OF CORRECTION

PATENT NO. : 5,490,600

DATED : February 13, 1996

INVENTOR(S) : Rafael T. Bustos

It is certified that error appears in the above-indentified patent and that said Letters Patent is hereby corrected as shown below:

Column 10, Line 41, "plurality" should read --a plurality--.

Column 10, Line 62, "said slid" should read --said slip--.

Column 11, Line 36, "said slid" should read --said slip--.

Column 11, Line 43, "notch" should read --a notch--.

Column 12, Line 16, "divider" should read --a divider--.

Column 12, Line 22, "slid" should read --slip--.

Column 12, Line 61, "slid" should read --slip--.

Column 14, Line 23, "slid" should read --slip--.

Column 16, Line 4, "slid" should read --slip--.

Signed and Sealed this

Eighteenth Day of June, 1996

*Attest:*

*Attesting Officer*

BRUCE LEHMAN

*Commissioner of Patents and Trademarks*